US007021113B1

(12) United States Patent
Peterson et al.

(10) Patent No.: US 7,021,113 B1
(45) Date of Patent: Apr. 4, 2006

(54) DEVICE FOR STRIPPING A WHEEL RIM FROM A WHEEL RIM EXPANDING TOOLING APPARATUS

(75) Inventors: Gary L. Peterson, Sedalia, MO (US); Harold L. Dump, Calhoun, MO (US)

(73) Assignee: Hayes Lemmerz International, Inc., Northville, MI (US)

( * ) Notice: Subject to any disclaimer, the term of this patent is extended or adjusted under 35 U.S.C. 154(b) by 364 days.

(21) Appl. No.: 10/427,704

(22) Filed: Apr. 30, 2003

(51) Int. Cl.
*B21D 39/20* (2006.01)
*B21D 45/06* (2006.01)

(52) U.S. Cl. ..... 72/393; 72/420

(58) Field of Classification Search ..... None
See application file for complete search history.

(56) References Cited

U.S. PATENT DOCUMENTS 4,282,736 A * 8/1981 Mashburn ..... 72/345
4,326,402 A * 4/1982 Wallis ..... 72/420
6,848,290 B1 * 2/2005 Pyper et al. ..... 72/405.06

* cited by examiner

*Primary Examiner*—Lowell A. Larson
(74) *Attorney, Agent, or Firm*—MacMillan, Sobanski & Todd, LLC

(57) ABSTRACT

An improved device for stripping a wheel rim from a wheel rim expanding tooling apparatus (100) includes an inboard wheel rim expanding tooling assembly (102) including a plurality of segmented inboard wheel rim press members, an outboard wheel rim expanding tooling assembly (104) including a plurality of segmented outboard wheel rim press members, and at least one stripper pin device (120) installed in at least one of the segmented inboard wheel rim press members or the segmented outboard wheel rim press members. The at least one stripper pin device is installed in the at least one of the segmented inboard wheel rim press members or the segmented outboard wheel rim press members from the outer surface side thereof.

21 Claims, 9 Drawing Sheets

DEVICE FOR STRIPPING A WHEEL RIM FROM A WHEEL RIM EXPANDING TOOLING APPARATUS

BACKGROUND OF THE INVENTION

This invention relates in general to vehicle wheels and in particular to an improved device for stripping a wheel rim from a wheel rim expanding tooling apparatus.

A conventional vehicle wheel is typically of a two-piece construction and includes an inner wheel disc and an outer "full" wheel rim. The wheel disc can be cast, forged, or fabricated from steel, aluminum, or other alloys, and includes an inner annular wheel mounting portion and an outer annular portion. The wheel mounting portion of the wheel disc defines an inboard mounting surface and includes a center pilot or hub hole, and a plurality of lug receiving holes formed therethrough for mounting the vehicle wheel to an axle of the vehicle. The wheel rim is fabricated from steel, aluminum, or other alloys, and includes an inboard tire bead seat retaining flange, an inboard tire bead seat, an axially extending well, an outboard tire bead seat, and an outboard tire bead seat retaining flange. In some instances, a three-piece wheel construction having a mounting cup secured to the wheel disc is used. In both types of constructions, the outer annular portion of the wheel disc is secured to the wheel rim by welding.

A full face vehicle wheel is distinguished from other types of wheels by having a one-piece wheel disc construction. In particular, the full face wheel includes a "full face" wheel disc and a "partial" rim. The full face wheel disc can be cast, forged, or fabricated from steel, aluminum, or other alloys. The full face wheel disc includes an inner annular wheel mounting portion and an outer annular portion which defines at least a portion of an outboard tire bead seat retaining flange of the wheel. The wheel mounting portion defines an inboard mounting surface and includes a center pilot or hub hole, and a plurality of lug receiving holes formed therethrough for mounting the wheel to an axle of the vehicle. The partial wheel rim is fabricated from steel, aluminum, or other alloys, and includes an inboard tire bead seat retaining flange, an inboard tire bead seat, an axially extending well, and an outboard tire bead seat. In some instances, the outboard tire bead seat of the wheel rim and the outer annular portion of the wheel disc cooperate to form the outboard tire bead seat retaining flange of the full face wheel. In both types of constructions, the outboard tire bead seat of the wheel rim is positioned adjacent the outer annular portion of the wheel disc and a weld is applied to join the wheel rim and the wheel disc together.

In the above wheel constructions, the wheel rim of the associated vehicle wheel is typically subjected to a final expanding operation to produce a finished wheel rim having a desired final profile prior to securing the wheel rim to the wheel disc by welding. A typical sequence of steps which can be used to produce a partial wheel rim for use in a full face type of vehicle wheel includes the steps of: (a) providing a flat sheet of suitable material, such as aluminum or steel; (b) forming the sheet into a cylindrical hoop or band; (c) flaring the lateral edges of the hoop radially outwardly to produce a rim preform having flanges suitable for positioning on a roll forming machine; (d) subjecting the rim preform to a series of roll forming operations to produce a wheel rim having a predetermined shape; and (e) expanding the wheel rim to a produce a finished wheel rim having a predetermined circumference; and (f) removing the wheel rim from the expanding tooling used in the step (e).

FIGS. 1 and 2 illustrate a prior art wheel rim expanding tooling apparatus, indicated generally at 200, which can be used in the step (e) above, to expand a wheel rim 30 to a produce a finished partial wheel rim 32 having a predetermined profile, and the step (f) above, to remove the wheel rim from the expanding tooling used in the step (e). As shown therein, the prior art wheel rim expanding tooling apparatus 200 includes an inboard wheel rim expanding tooling assembly, indicated generally at 202, and an outboard wheel rim expanding tooling assembly, indicated generally at 204. The inboard wheel rim expanding tooling assembly 202 and the outboard wheel rim expanding tooling assembly 204 are supported in a known manner for selective movement between an open, unexpanded position shown in prior art FIG. 1, and a closed, expanded position shown in prior art FIG. 2.

The inboard wheel rim expanding tooling assembly 202 includes an inboard expander press assembly 206, a barrel head 208, and an inboard expander press guide support assembly (not shown). The barrel head 208 and the inboard expander press guide support assembly are conventional in the art. The inboard expander press guide support assembly is operative to support the inboard expander press assembly 206 for selective movement between the open, unexpanded position shown in prior art FIG. 1 and the closed, fully expanded position shown in prior art FIG. 2.

The inboard expander press assembly 206 includes a plurality of segmented press members which are adapted to engage an inner surface of the associated vehicle wheel rim 30 and expand the wheel rim 30 to a desired final profile, shown at 32 in FIG. 2, during the above step (e). In the illustrated embodiment, the inboard expander press assembly 206 includes twelve segmented press members (only six of the segmented press members are shown in prior art FIGS. 1 and 2 and identified as 206A–206F). Each of the segments 206A–206F are generally identical to each other.

The outboard wheel rim expanding tooling assembly 204 includes an outboard expander press assembly 210, a barrel head 212, and an outboard expander press guide support assembly (not shown). The barrel head 212 and the inboard expander press guide support assembly are conventional in the art. The outboard expander press guide support assembly is operative to support the outboard expander press assembly 210 for selective movement between the open, unexpanded position shown in prior art FIG. 1, and the closed, fully expanded position shown in prior art FIG. 2.

The prior art outboard expander press assembly 210 includes a plurality of segmented press members which are adapted to engage the inner surface of the vehicle wheel rim 30 and expand the wheel rim 30 to a desired final profile, shown at 32 in FIG. 2, during the above step (e). In the illustrated embodiment, the outboard expander press assembly 210 includes twelve segmented press members (only six of the segmented press members are shown in prior art FIGS. 1 and 2 and identified as 210A–210F). Each of the segments 210A–210F are generally identical to each other. Thus, for discussion purposes, the discussion with respect to any one of the segments 210A–210F of the prior art outboard expanding tooling assembly 204 will generally apply to all the other segments.

As shown in prior FIG. 3, the segment 210A includes an outer surface 216 having a desired profile which generally corresponds to the final desired profile of the wheel rim. The segment 210A is provided with an opening 218 formed therethrough. As shown in prior art FIG. 3A, the opening 218 is of a stepped opening configuration and includes a lower or inner threaded portion 218A and an upper or outer non-threaded portion 218B. The inner threaded portion 218A defines a first opening diameter D1 and extends a radial distance X1. The outer non-threaded portion 218B of the opening 218 defines a second opening diameter D2 which is less than the first opening diameter D1.

The segment 214 of the prior art outboard expander press assembly 210 (as well as all the other segments of the outboard expander press assembly 210), further includes a prior art rim removal or stripper pin assembly, indicated generally at 220, in FIG. 4. As shown therein, the prior art stripper pin assembly 220 includes a stripper pin 222, a spring 224, and a set screw or stud 226. The stripper pin 222 includes an outer portion 222A, an intermediate portion 222B, and an inner portion 222C. The outer portion 222A defines a first pin diameter D3, the intermediate portion 222B defines a second pin diameter D4, and the inner portion 222C defines a third pin diameter D5. In the illustrated prior art embodiment, the third pin diameter D5 is greater than the first pin diameter D3 and less than the second pin diameter D4. Also, the second opening diameter D2 is slightly greater than the first pin diameter D3. The prior art pin 222 further includes an outer shoulder S1 and an inner shoulder S2. The outer portion 222A of the stripper pin 222 also defines an outer portion radial dimension X2.

The spring 224 is a coiled compression spring and includes a first or outer coiled end 224A and an opposite second or inner coiled end 224B. The set screw includes a first or outer end 226A, an opposite second or outer end 226B, and an externally threaded main body 226C extending between the ends 226A and 226B. The outer end 226B of the set screw 226 defines a spring seat having a slightly chamfered or beveled surface. The set screw 226 further includes an internal opening 226D. The opening 226D has a hexagonal shape to provide an internal drive socket adapted to enable a suitable shaped tool (not shown) to be used to adjust the position of the set screw 226 in the opening 218. Thus, it can be seen that by adjusting the position of the stud 226 in the opening 218, the force that the spring 224 applies to the shoulder S2 of the stripper pin 222 can be varied. Also, it can be seen that the shoulder S1 of the stripper pin 222 engages a surface 218C of the opening 218 under the bias of the spring 224 when no wheel is present the wheel rim expanding tooling apparatus 210. Thus, the maximum distance that the outer end 222A of the stripper pin 222 can extend radially outwardly from the surface 216 of the segment 214A is a radial distance X3, defined by the equation X2−X1.

In operation, when the prior art wheel rim expanding tooling apparatus 200 is in the closed, fully expanded position shown in prior art FIG. 2, the associated wheel rim is expanded to produce a finished wheel rim having a desired final profile. During this operation, the inner surface of the wheel rim contacts the associated outer surface of each of the segments of the inboard and outboard wheel rim expanding tooling assemblies, 202 and 204 respectively. As a result of this, the outer end 222A of the stripper pin 222 is moved radially inwardly against the force of the spring 224 so that an outermost end surface 222D of the outer end 222A of the stripper pin 222 is located substantially flush with the associated outer surface of each of the segments of the outboard wheel rim expanding tooling assembly 214. After this operation, the wheel rim expanding tooling apparatus 200 is moved to a closed, unexpanded position (not shown). In this position under the bias of the spring 224, the stripper pin 222 moves to its fully extended position and exerts a force sufficient to engage and slightly lift or raise the outboard flange of the final expanded wheel rim from the associated wheel rim expanding tooling assembly. Once this occurs, the wheel rim expanding tooling assemblies 202 and 204 can be moved to the open, unexpanded position shown in prior art FIG. 1.

SUMMARY OF THE INVENTION

This invention relates an improved device for stripping a wheel rim from a wheel rim expanding tooling apparatus. The wheel rim expanding tooling apparatus is adapted to produce an expanded finished wheel rim having an inboard tire bead seat retaining flange, an inboard tire bead seat, a generally axially extending well, and an outboard tire bead seat. The wheel rim expanding tooling apparatus includes an inboard wheel rim expanding tooling assembly and an outboard wheel rim expanding tooling assembly. The inboard wheel rim expanding tooling assembly includes a plurality of segmented inboard wheel rim press members. Each of the segmented inboard wheel rim press members includes an outer surface having a desired profile which is adapted to engage an inner surface of the wheel rim and expand the wheel rim to a desired final profile. The outboard wheel rim expanding tooling assembly includes a plurality of segmented outboard wheel rim press members. Each of the segmented outboard wheel rim press members includes an outer surface having a desired profile which is adapted to engage an inner surface of the wheel rim and expand the wheel rim to a desired final profile. The wheel rim expanding tooling apparatus further includes at least one stripper pin device installed in at least one of the segmented inboard wheel rim press members or the segmented outboard wheel rim press members. The at least one stripper pin device is installed in the at least one of the segmented inboard wheel rim press members or the segmented outboard wheel rim press members from the outer surface side thereof.

Other advantages of this invention will become apparent to those skilled in the art from the following detailed description of the preferred embodiments, when read in light of the accompanying drawings.

DESCRIPTION OF THE PREFERRED EMBODIMENTS

Figure 1:
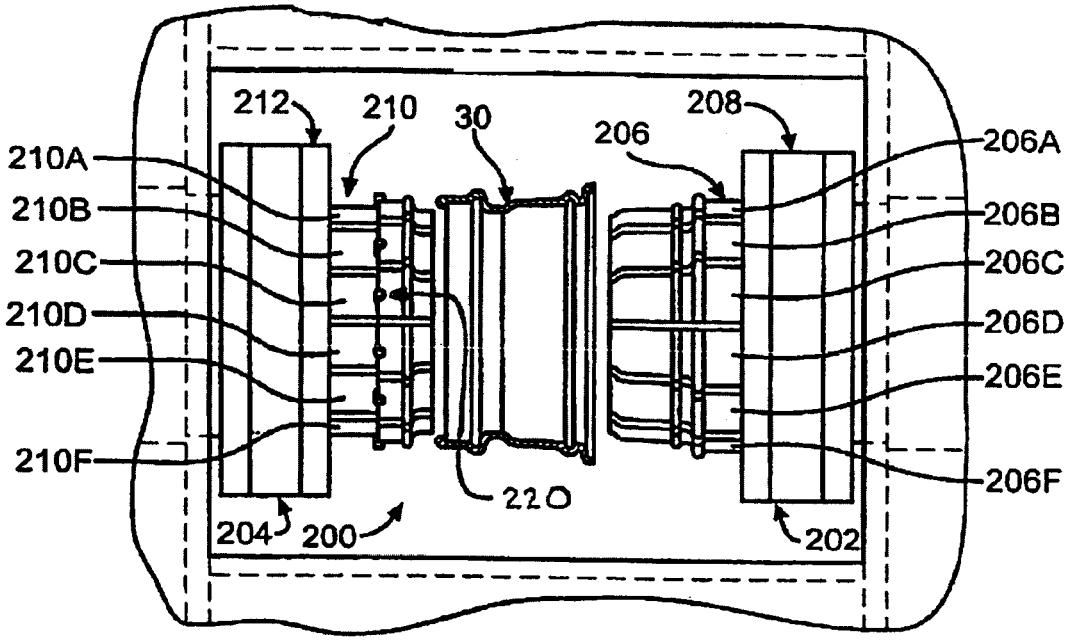
FIG. 1 (PRIOR ART)
FIG. 1 is an elevational view of a prior art wheel rim expanding tooling apparatus, with the wheel rim expanding tooling apparatus being shown in an open, unexpanded non-working position.
Figure 2:
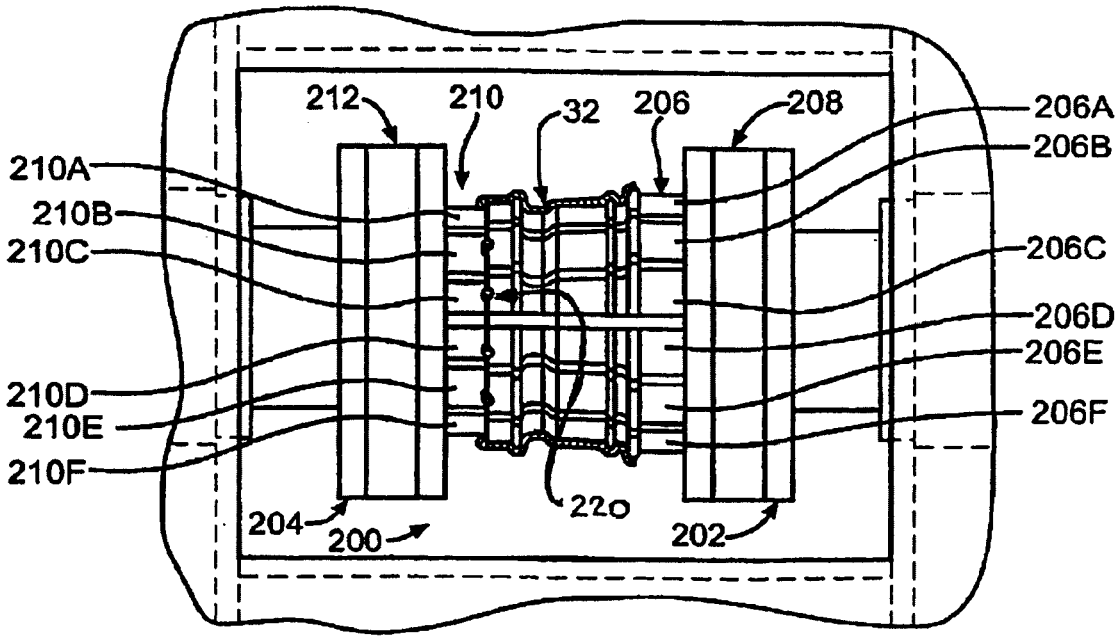
FIG. 2 (PRIOR ART)
FIG. 2 is an elevational view similar to FIG. 1 and showing the prior art wheel rim expanding tooling apparatus in a closed, fully expanded position.
Figure 3:
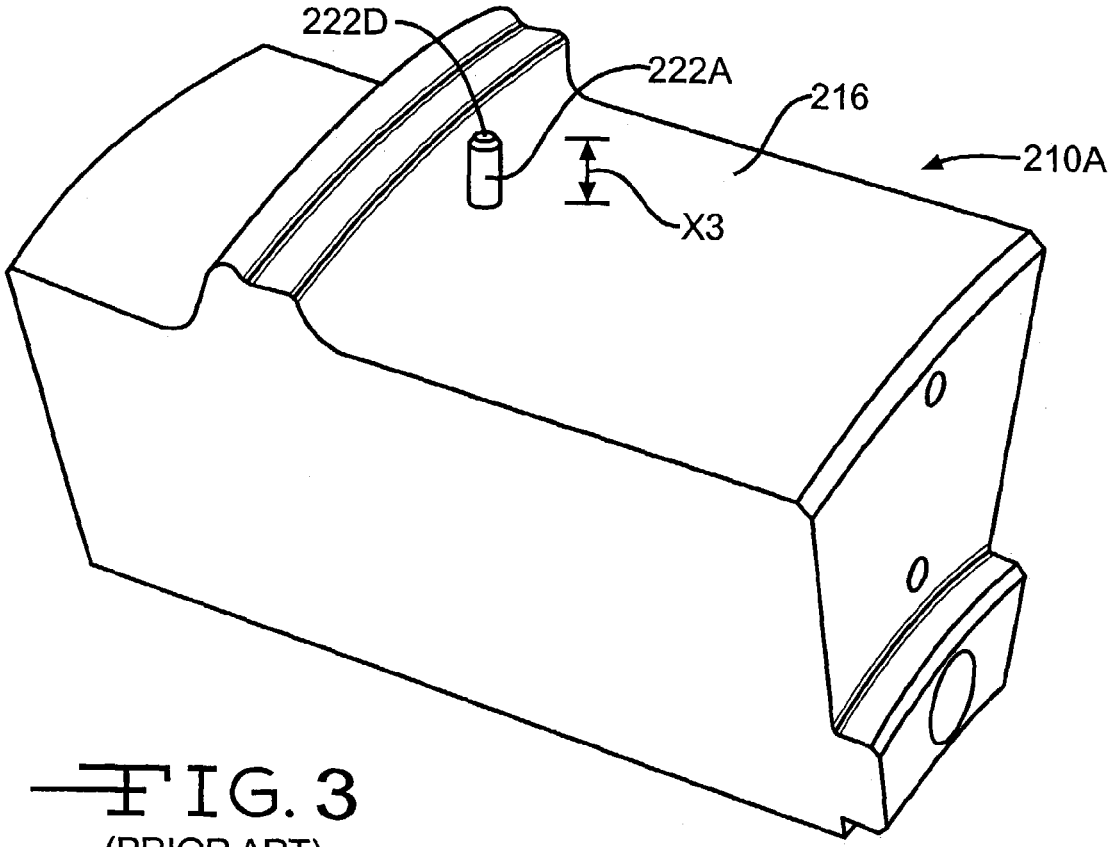
FIG. 3 (PRIOR ART)
FIG. 3 is a perspective view of a portion of a segment of one of the prior art wheel expanding tooling assemblies of the wheel rim expanding tooling apparatus shown in prior art FIGS. 1 and 2.
Figure 4:
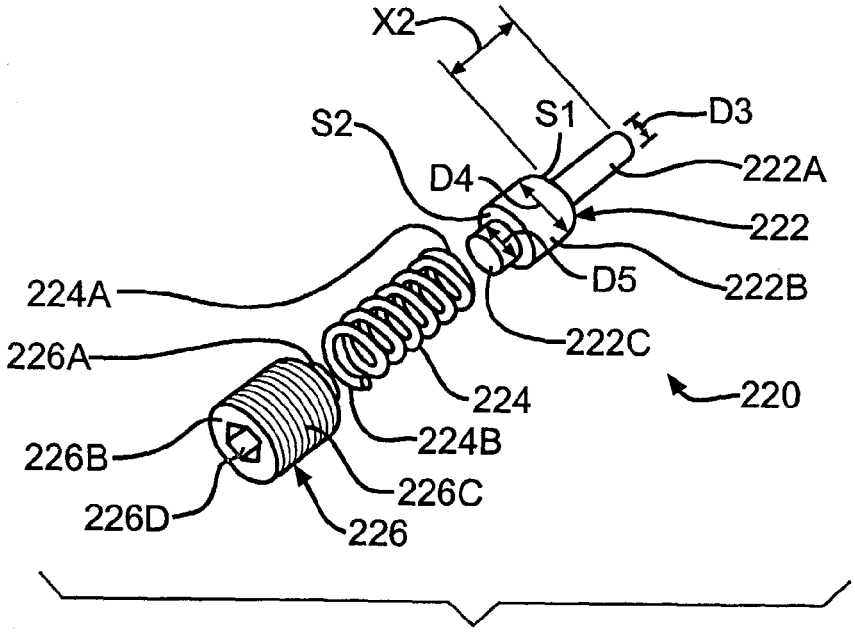
FIG. 4 (PRIOR ART)
FIG. 4 is an exploded perspective view of a prior art pin stripper assembly illustrated in prior art FIGS. 1, 2, 3 and 3A.
Figure 3A:
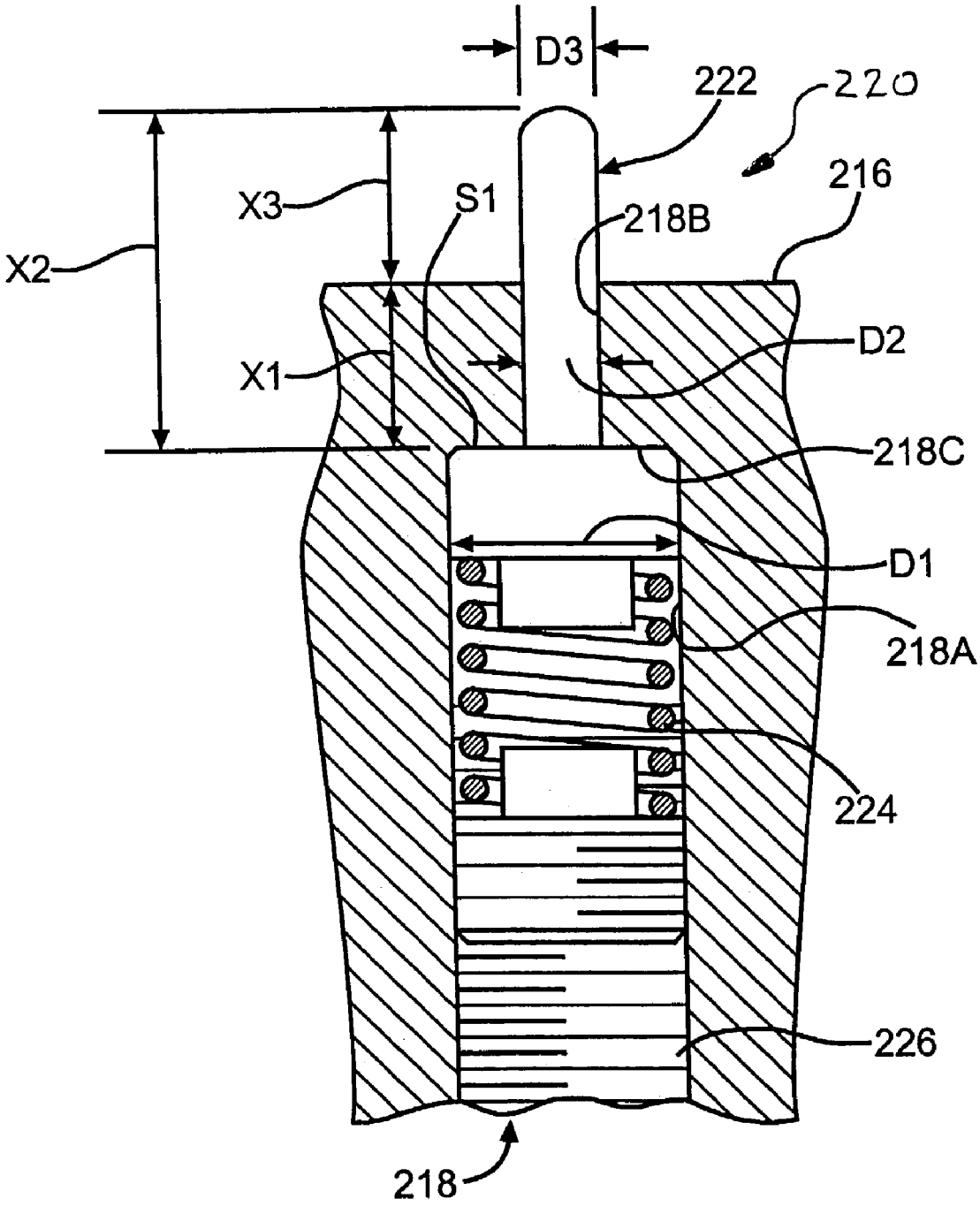
FIG. 3A (PRIOR ART)
FIG. 3A is a sectional view of a portion of prior art FIG. 3.
Figure 5:
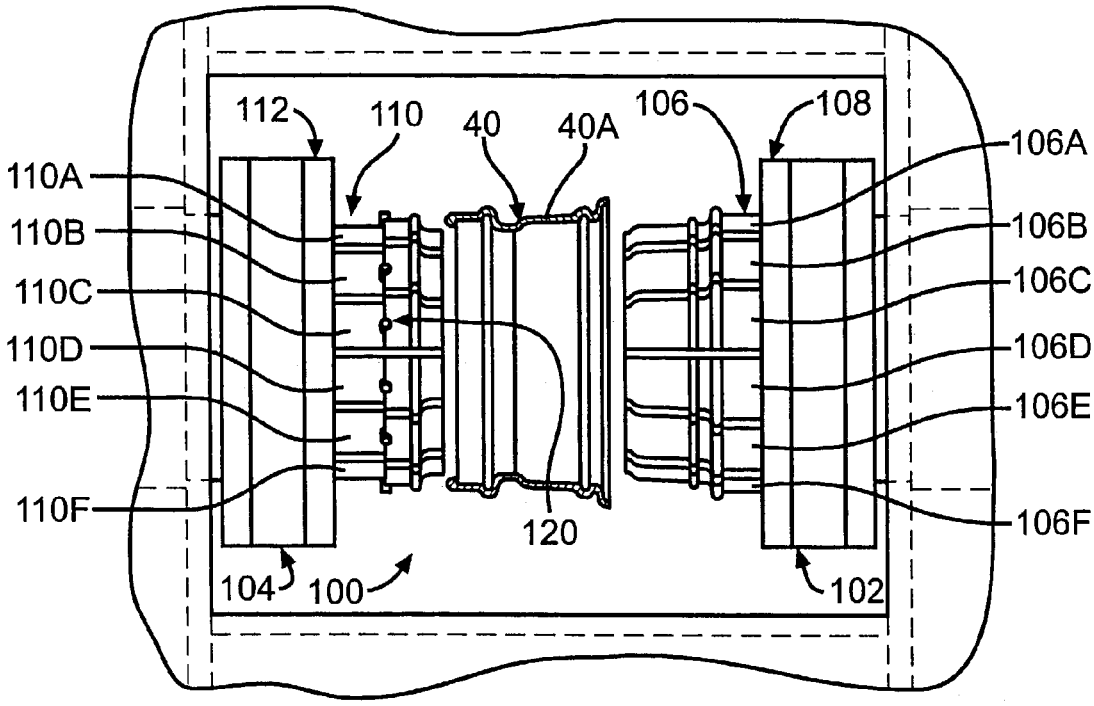
FIG. 5 is an elevational view of a wheel rim expanding tooling apparatus, in accordance with this invention, with the wheel rim expanding tooling apparatus being shown in an open, unexpanded non-working position.
Figure 6:
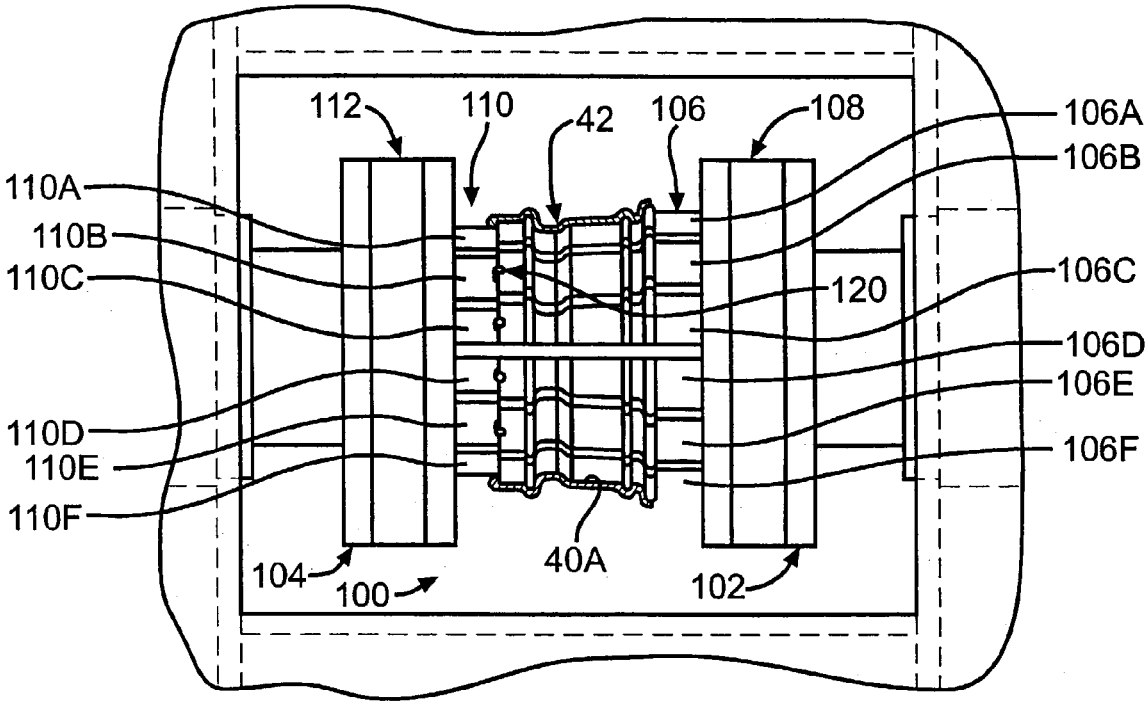
FIG. 6 is an elevational view similar to FIG. 5 and showing the wheel rim expanding tooling apparatus of the present invention in a closed, fully expanded position.

Referring now to FIGS. 5 and 6, there is illustrated a wheel rim expanding tooling apparatus, indicated generally at 100, in accordance with this invention. As shown in this embodiment, the wheel rim expanding tooling apparatus 100 is used to produce a finished expanded partial wheel rim 42 adapted for use in a full face vehicle wheel, indicated generally at 70 in FIG. 12. While the present invention will be described and illustrated in connection with the particular vehicle wheel disclosed herein, it is understood that the invention can be used to produce a wheel rim for use in constructing other types of vehicle wheels, if so desired.

As shown in FIGS. 5 and 6, the wheel rim expanding tooling apparatus 100 includes inboard wheel rim expanding tooling assembly, indicated generally at 102, and an outboard wheel rim expanding tooling assembly, indicated generally at 104. The inboard wheel rim expanding tooling assembly 102 includes an inboard expander press assembly 106, a barrel head 108, and an inboard expander press guide support assembly (not shown). The barrel head 108 and the inboard expander press guide support assembly are conventional in the art. The inboard expander press guide support assembly is operative to support the inboard expander press assembly 106 for selective movement between the open, unexpanded position shown in FIG. 5 and the closed, fully expanded position shown in FIG. 6.

The inboard expander press assembly 106 includes a plurality of segmented press members which are adapted to engage an inner surface 40A of the associated vehicle wheel rim 40 and expand the wheel rim 40 to a desired final profile, as shown at 42 in FIG. 6, during the expanding step of the step (e) above. In the illustrated embodiment, the inboard expander press assembly 106 includes twelve segmented press members (only six of the segmented press members are shown in FIGS. 5 and 6 and identified as 106A–106F). Each of the segments 106A–106F are generally identical to each other. Alternatively, one or more of the segments 106A–106F of the inboard press assembly 106 can not be identical to the others, if so desired.

The outboard wheel rim expanding tooling assembly 104 includes an outboard expander press assembly 110, a barrel head 112, and an outboard expander press guide support assembly (not shown). The barrel head 112 and the inboard expander press guide support assembly are conventional in the art. The outboard expander press guide support assembly is operative to support the outboard expander press assembly 110 for selective movement between the open, unexpanded position shown in FIG. 5 and the closed, expanded position shown in FIG. 6.

Figure 7:
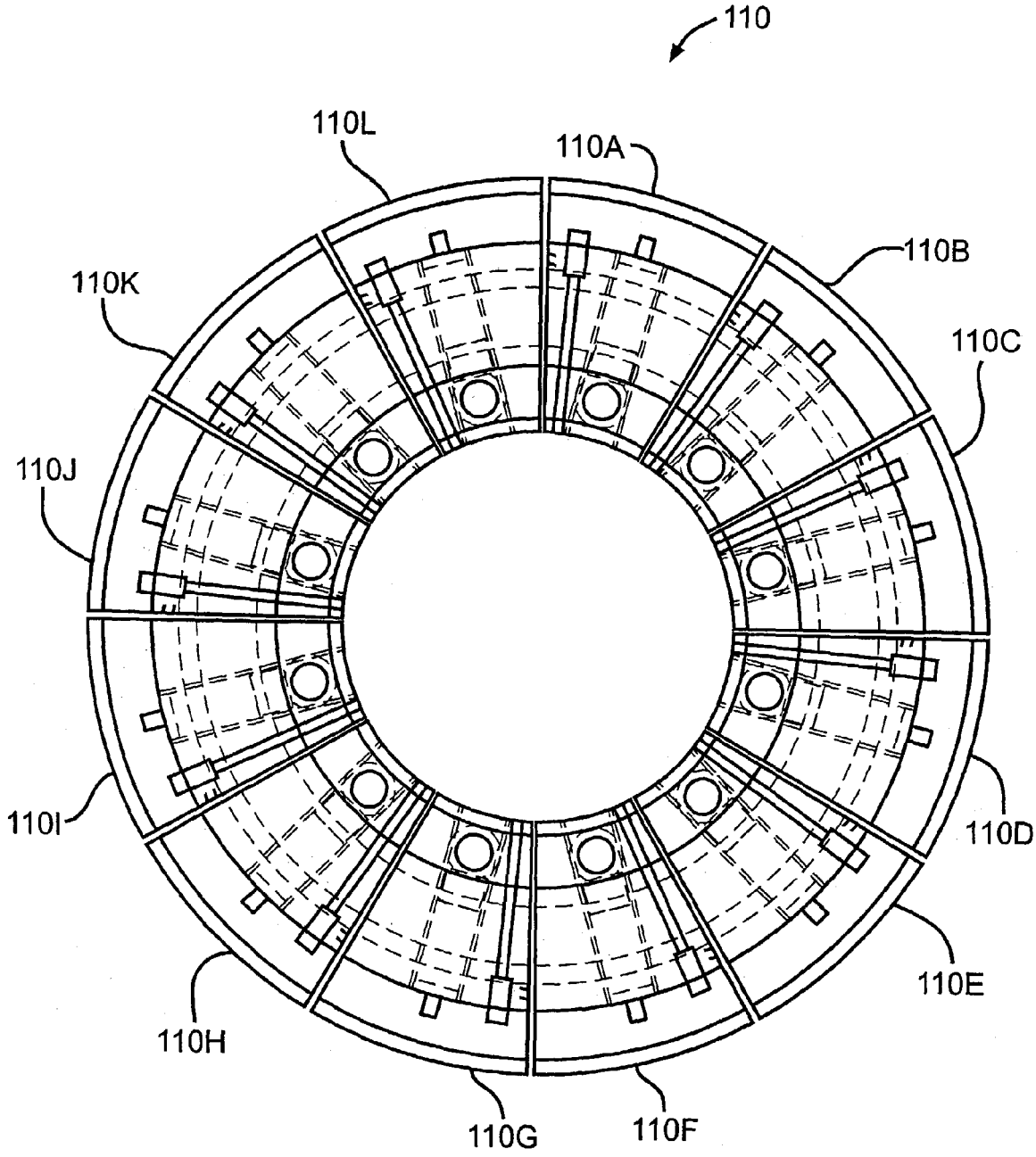
FIG. 7 is a sectional view of a portion of the wheel rim expanding tooling apparatus shown in FIGS. 5 and 6, in accordance with this invention.

The outboard expander press assembly 110 includes a plurality of segmented press members which are adapted to engage the inner surface 40A of the vehicle wheel rim 40 and expand the wheel rim 40 to a desired final profile, as shown at 42 in FIG. 6, during the expanding step of the step (e) above. In the illustrated embodiment, the outboard expander press assembly 110 includes twelve segmented press members (all twelve of the segments identified as 110A–110L in FIG. 7). Each of the segments 110A–110L are generally identical to each other. Thus, for discussion purposes, the discussion with respect to any one of the segments 110A–110L of the outboard expander press 110 will generally apply to all the other segments. Alternatively, one or more of the segments 110A–110L of the outboard press assembly 110 can not be identical to the others, if so desired.

Figure 8:
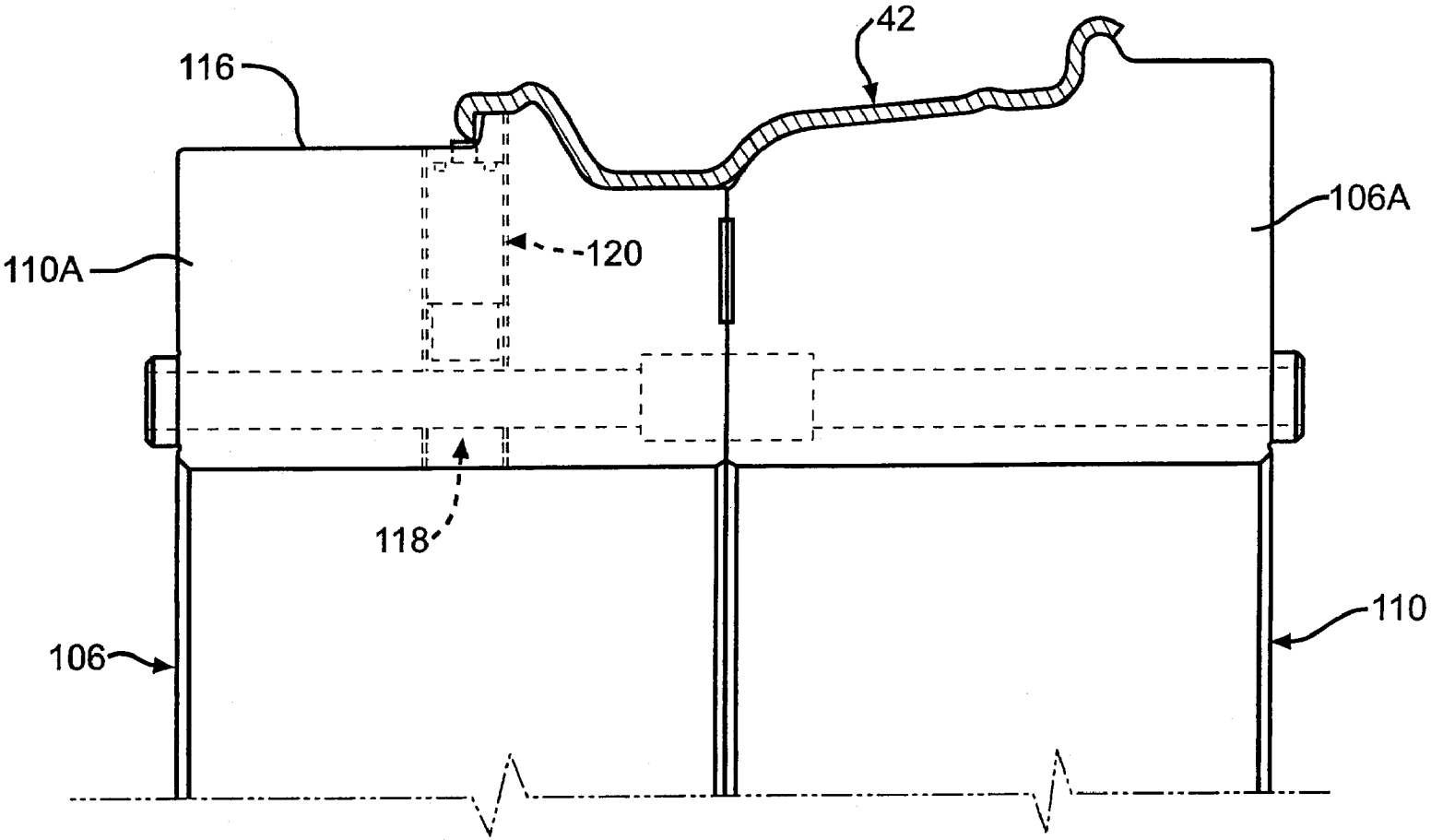
FIG. 8 is a sectional view of the wheel rim expanding tooling apparatus of the present invention, the wheel rim expanding tooling apparatus being shown in the closed, fully expanded position, with a stripper pin assembly, in accordance with this invention, shown in the retracted position.
Figure 9:
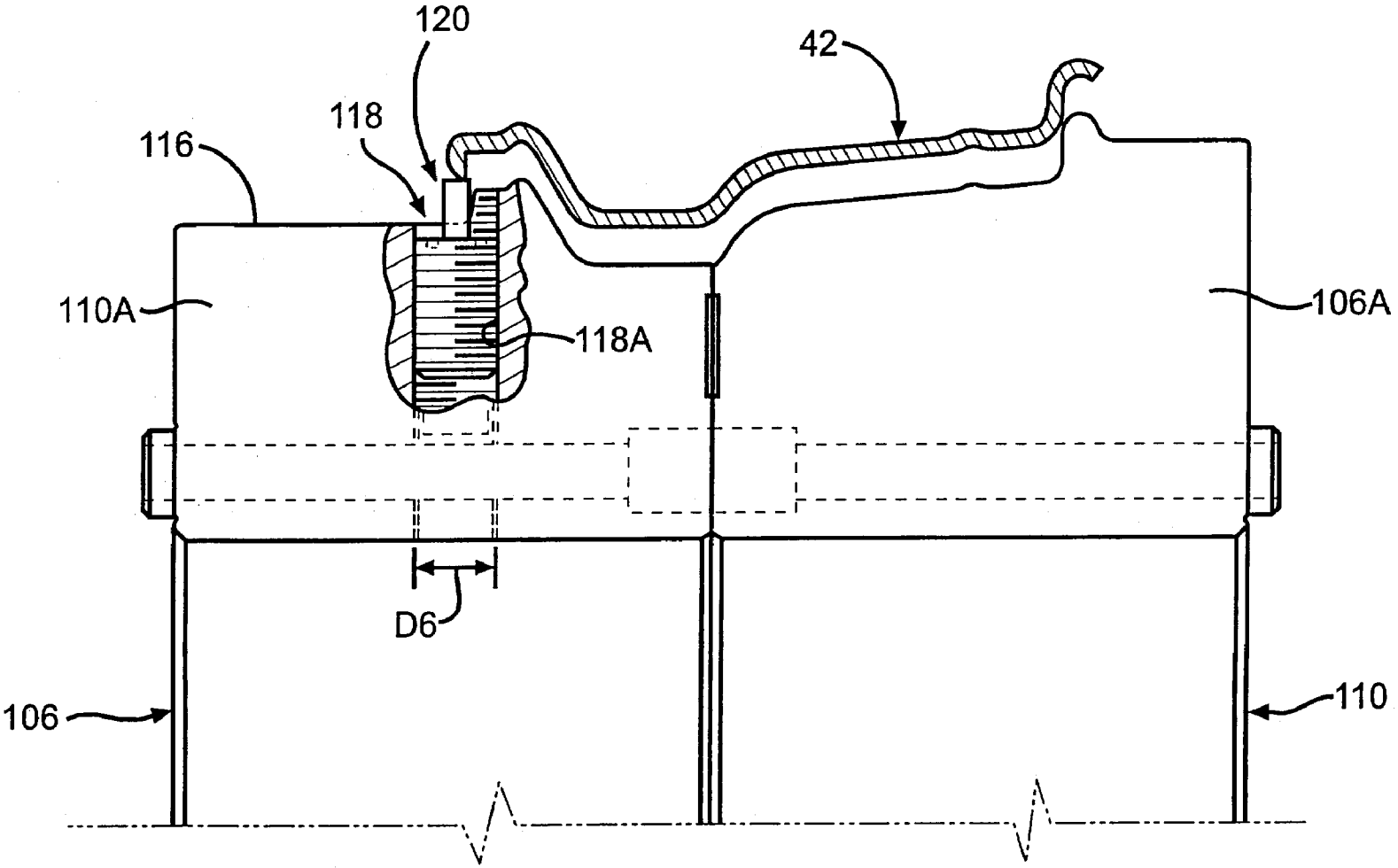
FIG. 9 is a sectional view of the wheel rim expanding tooling apparatus of the present invention, the wheel rim expanding tooling apparatus being shown in the closed, unexpanded position, with the stripper pin assembly, in accordance with this invention, shown in the fully extended position.
Figure 10:
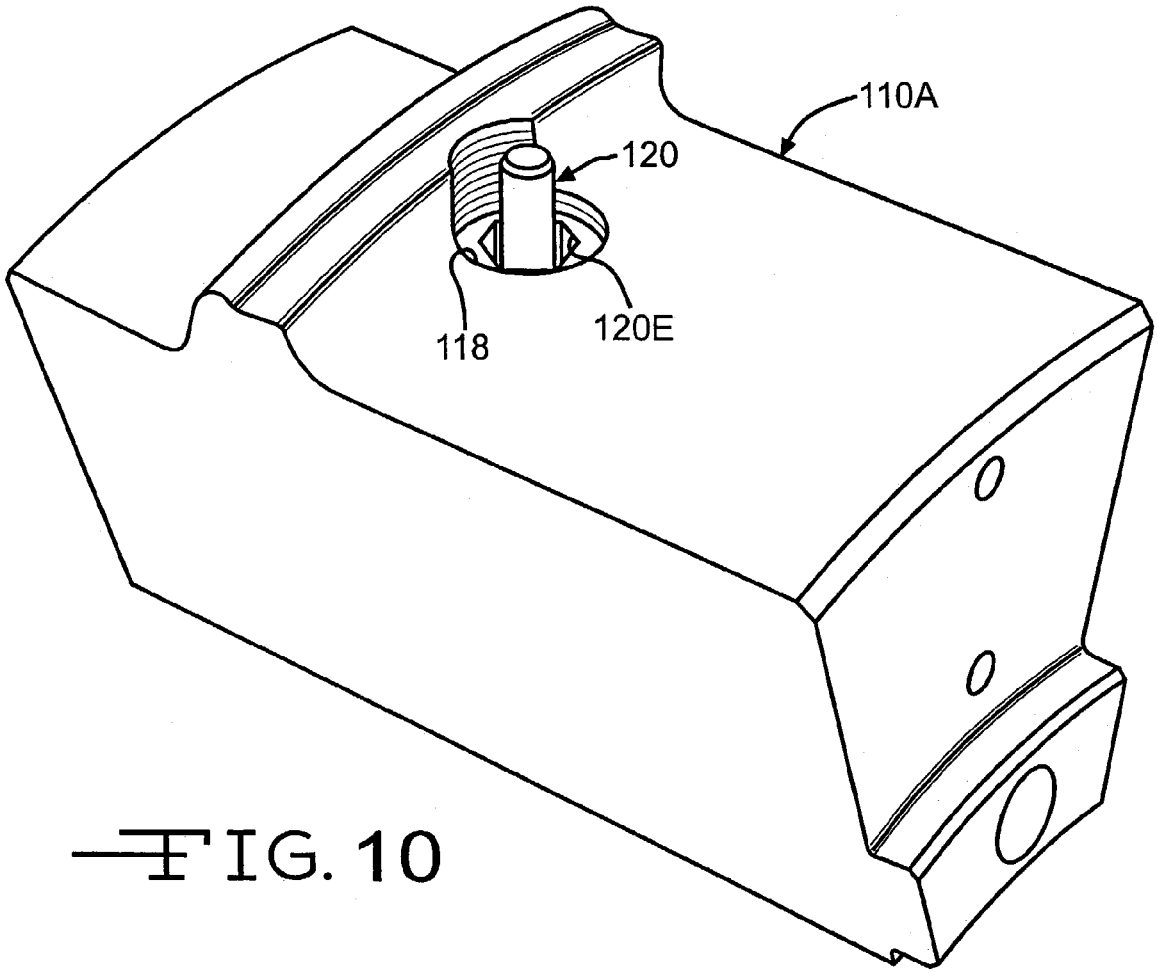
FIG. 10 is a perspective view of a portion of a segment of one of the wheel expanding tooling assemblies of the wheel rim expanding tooling apparatus shown in FIG. 5, in accordance with this invention.

As shown in FIGS. 8 and 9, the segment 110A includes an outer surface 116 having a desired profile which generally corresponds to the final desired profile of the wheel rim. The segment 110A is provided with an opening 118 formed therethrough. In the illustrated embodiment, the opening 118 is a through opening and extends completely through the segment 110A. In the illustrated embodiment, the opening 118 includes a first or outer portion 118A and a second or inner portion 118B. The first portion 118A defines partial internal threads and the second portion 118B defines full internal threads and has a constant diameter D6 along the entire length thereof. Alternatively, the structure of the opening 118 can be other than illustrated if so desired. For example, the opening 118 could only extend partially into the segment 110A from the outer side surface 116A thereof, if so desired.

Turning now to FIGS. 7–11, a stripper pin assembly, indicated generally at 120, according to the present invention adapted for use with outboard expander press assembly 10 of the present invention will be discussed. As shown therein, the stripper pin assembly 120 is an integral or self-contained pneumatic or gas spring device. A suitable gas spring device 120 is part number C.090.015 micro series nitrogen gas spring manufactured by Dadco, Inc. of Plymouth, Mich. The gas spring device 120 is preferably precharged to provide a predetermined force. A suitable force that the gas spring device 120 applies is approximately in the range from about 240 psi to about 640 psi; however, the force can be other than described depending upon the particular wheel rim application. Alternatively, other suitable types of pneumatic or gas spring devices can be used if so desired. Also, the gas spring device 120 can of the adjustable type if so desired. Also, as shown in this embodiment, a stripper pin assembly 120 is provided in each of the segments 110A–110L of the outboard expander press assembly 110; however, only one or more of the segments 110A–110L of the outboard expander press assembly 110 could be provided with a stripper pin assembly 120 if so desired. For example, only the four uppermost segments of the outboard expander press assembly 110 (i.e., segments 110K, 110L, 110A and 110B in FIG. 7), could be provided with the stripper pin assembly 120 if so desired. Also, in the illustrated embodiment, only the segments 110A–110L of the outboard expander press assembly 110 include the stripper pin assembly 120 and the stripper pin assembly 120 is adapted to engage an associated outboard flange portion of the wheel rim; however, depending upon the particular profile of the associated wheel rim, the stripper pin assembly 120 of the present invention could be located in a different location in the outboard expander press assembly 110 and/or could be located in the inboard expander press assembly 106 if so desired.

Figure 11:
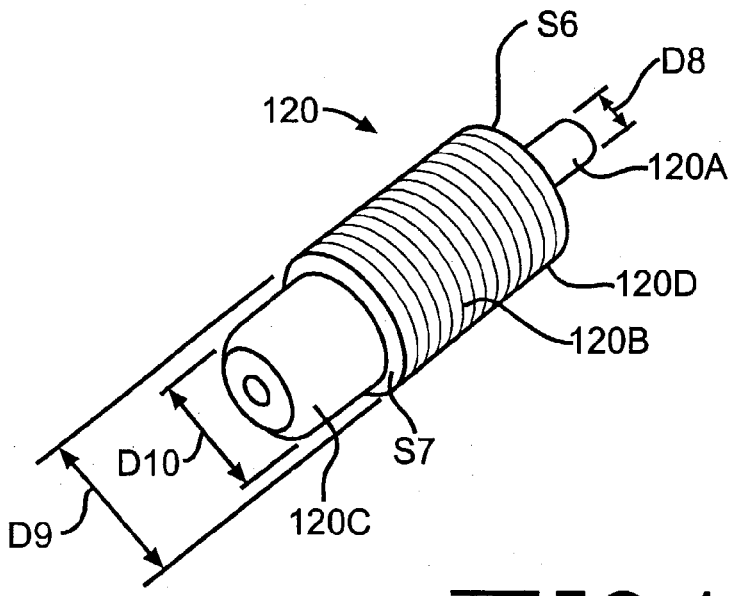
FIG. 11 is a perspective view of the stripper pin assembly, illustrated in FIGS. 5, 6, 7, 8, 9 and 10, in accordance with this invention.

As best shown in FIG. 11, the stripper pin assembly includes an outer end portion 120A, an intermediate portion 120B, and an inner portion 120C. In the illustrated embodiment, the outer portion 120A is a non-threaded portion and defines a first diameter D8; the intermediate portion 120B is provided with external threads 120D and defines a second diameter D9; and the inner portion 120C is non-threaded and defines a third diameter D9. In the illustrated embodiment, the third diameter D10 is greater than the first diameter D8 and less than the second diameter D9. The stripper pin assembly 120 further includes an outer shoulder S6 and an inner shoulder S7. Thus, it can be seen that by adjusting the position of the stripper pin assembly 120 in the opening 118, the resulting force that the stripper pin assembly 120 applies to the wheel rim can be easily adjusted. To accomplish this, the intermediate portion 120B of the stripper pin 120 includes a hexagonal shaped internal socket 120E, shown in FIG. 10. The socket 120E is adapted to enable a suitable shaped tool (not shown) to be used to thereby adjust the position of the stripper pin assembly 120 in the opening 118.

Figure 12:
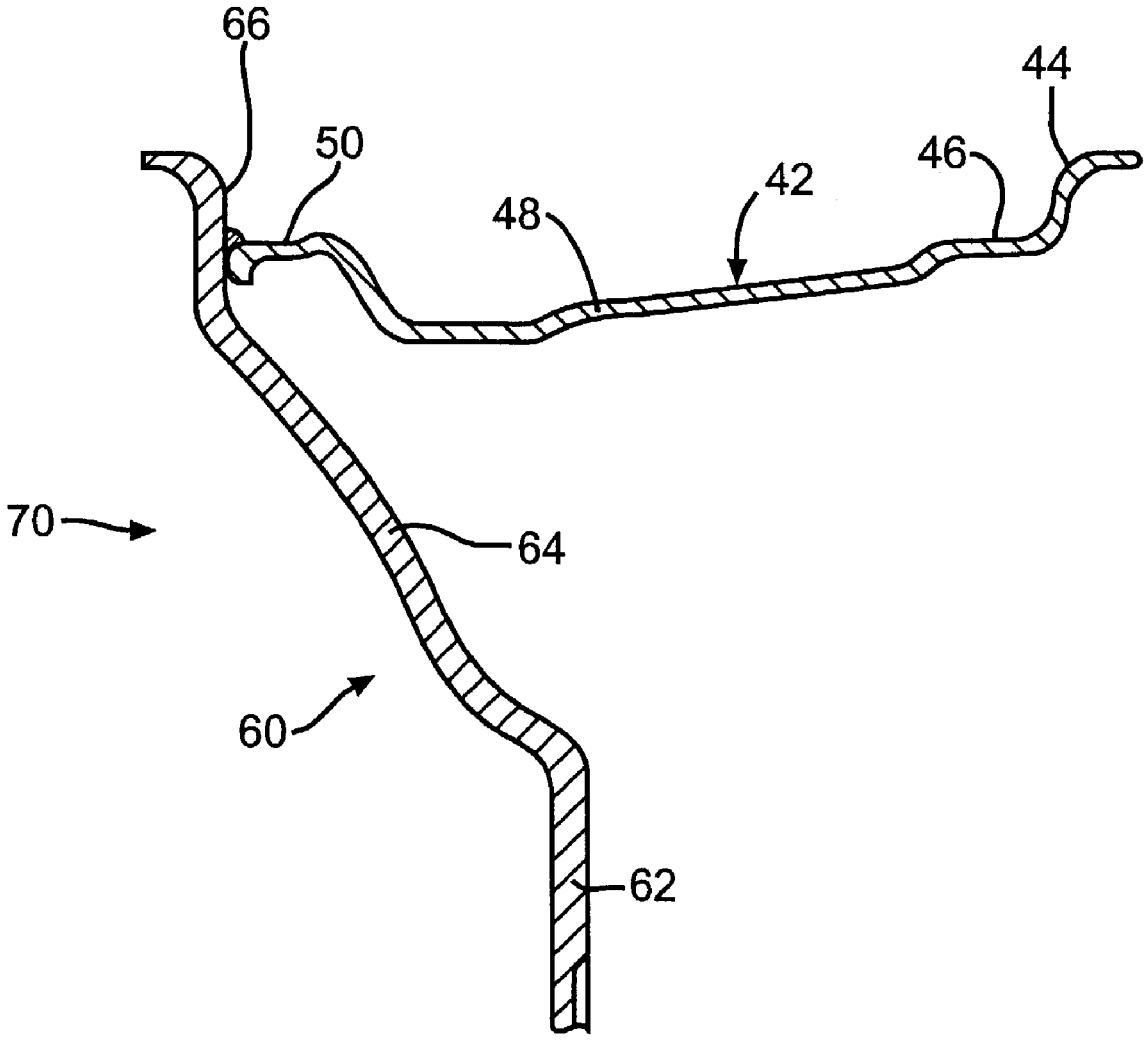
FIG. 12 is a partial sectional view of a vehicle wheel constructed using a wheel rim produced using the wheel rim expanding tooling apparatus in accordance with the present invention.

As shown in FIGS. 8 and 9, the "expanded" finished wheel rim 42 includes an inboard tire bead seat retaining flange 44, an inboard tire bead seat 46, a generally axially extending well 48, and outboard tire bead seat 50. The expanded finished wheel rim 42 is secured to a preformed full face wheel disc, indicated generally at 60 in FIG. 12, by welding to produce a finished full face vehicle wheel 70. As shown in FIG. 12, the full face wheel disc 60 includes an inner annular wheel mounting portion 62 and an outer annular portion 64 which defines at least a portion of an outboard tire bead seat retaining flange 66 of the wheel. The wheel disc 60 can be formed from steel, aluminum, or alloys thereof depending upon the construction of the associated wheel rim 42.

One advantage of the present invention is that the stripper pin assembly 120 is installed in the associated wheel rim expanding tooling segment 110A–110L from exterior or topside surface thereof. As a result, the stripper pin assembly 120 of the present invention can be repaired and/or replaced without requiring the disassembly of the associated wheel rim expanding tooling assembly 110. The prior art stripper pin assembly 220 was installed in the associated wheel rim expanding tooling segment 210A–210F from the interior or underside surface thereof which required the disassembly of the associated wheel rim expanding tooling assembly 210. Thus, the stripper pin assembly 120 of the present invention is easier to maintain, repair and/or replace and reduces production downtime compared to that required by the prior art stripper pin assembly 220. Also, the stripper pin assembly 120 of the present invention improves part removal from the associated wheel rim expanding tooling assembly by providing a more controlled stripping force compared to that provided by the prior art "mechanical pin and spring" type of stripper pin assembly. In addition, the position of the stripper pin assembly 120 of the present invention can be easily adjusted compared to prior art stripper pin assembly 220. This is because the stripper pin assembly 120 of the present invention is installed in the associated wheel rim expanding tooling segment 110A–110L from exterior or topside surface thereof and its position in the associated opening 118 can be adjusted without requiring the disassembly of the associated wheel rim expanding tooling assembly 110. In the prior art wheel rim tooling assembly 210, the stripper pin assembly 220 is installed from the underside of the tooling which required disassembly of the tooling to change the position of the stripper pin assembly 220 in the associated opening 218. Thus, the stripper pin assembly 120 of the present enables the force that it provides to strip the part from the tooling to be varied or adjusted more easily compared to the of the prior art stripper pin assembly.

In accordance with the provisions of the patent statutes, the principle and mode of operation of this invention have been described and illustrated in its preferred embodiments. However, it must be understood that the invention may be practiced otherwise than as specifically explained and illustrated without departing from the scope or spirit of the attached claims.

What is claimed is:

1. A wheel rim expanding tooling apparatus adapted to produce an expanded finished wheel rim, the expanded wheel rim having an inboard tire bead seat retaining flange, an inboard tire bead seat, a generally axially extending well, and outboard tire bead seat, the wheel rim expanding tooling apparatus comprising:

an inboard wheel rim expanding tooling assembly including a plurality of segmented inboard wheel rim press members, each of said segmented inboard wheel rim press members including an outer surface having a desired profile which is adapted to engage an inner surface of the wheel rim and expand the wheel rim to a desired final profile;

an outboard wheel rim expanding tooling assembly including a plurality of segmented outboard wheel rim press members, each of said segmented outboard wheel rim press members including an outer surface having a desired profile which is adapted to engage an inner surface of the wheel rim and expand the wheel rim to a desired final profile; and at least one stripper pin device installed in at least one of said segmented inboard wheel rim press members or said segmented outboard wheel rim press members, said at least one stripper pin device installed in said at least one of said segmented inboard wheel rim press members or said segmented outboard wheel rim press members from said outer surface side thereof; wherein said at least one stripper pin device is provided with an outwardly facing internal socket which is accessible from said outer surface side of said at least one of said segmented inboard wheel rim press members or said segmented outboard wheel rim press members to thereby enable the position of said at least one stripper pin device to be adjusted from said outer surface side after said at least one stripper pin device is installed.

2. The wheel rim expanding tooling apparatus of claim 1 wherein said at least one stripper pin device is installed in said at least one of said segmented outboard wheel rim press members.

3. The wheel rim expanding tooling apparatus of claim 1 wherein said at least one stripper pin device is a precharged gas spring.

4. The wheel rim expanding tooling apparatus of claim 1 wherein said at least one stripper pin device is an adjustable gas spring.

5. The wheel rim expanding tooling apparatus of claim 1 wherein said at least one stripper pin is installed in a threaded opening provided in said at least one of said segmented inboard wheel rim press members or said segmented outboard wheel rim press members.

6. The wheel rim expanding tooling apparatus of claim 5 wherein said opening includes a first portion and a second portion, said first portion having partial internal threads and said second portion having full internal threads and a constant diameter along an entire length thereof.

7. The wheel rim expanding tooling apparatus of claim 1 wherein a plurality of said stripper pin devices are installed in said segmented inboard wheel rim press members or said segmented outboard wheel rim press members.

8. The wheel rim expanding tooling apparatus of claim 1 wherein a plurality of said stripper pin devices are installed in said segmented outboard wheel rim press members.

9. The wheel rim expanding tooling apparatus of claim 1 wherein said stripper pin device includes an outer end portion, an intermediate portion, and an inner portion, said outer portion being non-threaded portion and defining a first diameter, said intermediate portion provided with external threads and defining a second diameter, and said inner portion being non-threaded and defining a third diameter.

10. The wheel rim expanding tooling apparatus of claim 9 wherein said third diameter is greater than said first diameter and less than said second diameter.

11. A wheel rim expanding tooling apparatus adapted to produce an expanded finished wheel rim, the expanded wheel rim having an inboard tire bead seat retaining flange, an inboard tire bead seat, a generally axially extending well, and outboard tire bead seat, the wheel rim expanding tooling apparatus comprising:

an inboard wheel rim expanding tooling assembly including a plurality of segmented inboard wheel rim press members, each of said plurality of segmented inboard wheel rim press members including an outer surface having a desired profile which is adapted to engage an inner surface of the wheel rim and expand the wheel rim to a desired final profile;

an outboard wheel rim expanding tooling assembly including a plurality of segmented outboard wheel rim press members, each of said plurality of segmented outboard wheel rim press members including an outer surface having a desired profile which is adapted to engage an inner surface of the wheel rim and expand the wheel rim to a desired final profile; and a plurality of stripper pin devices installed in threaded openings provided in said plurality of segmented inboard wheel rim press members or said plurality of segmented outboard wheel rim press members, said plurality of stripper pin devices installed in said threaded openings of said plurality of segmented inboard wheel rim press members or said plurality of segmented outboard wheel rim press members from said outer surface side thereof; wherein each of said plurality of stripper pin devices is provided with an outwardly facing internal socket which is accessible from said outer surface side of said plurality of segmented inboard wheel rim press members or said plurality of segmented outboard wheel rim press members to thereby enable the position of said plurality of stripper pin devices to be adjusted from said outer surface side after said plurality of stripper pin devices are installed.

12. The wheel rim expanding tooling apparatus of claim 11 wherein said plurality of said stripper pin devices are installed in threaded openings provided in said plurality of segmented outboard wheel rim press members.

13. The wheel rim expanding tooling apparatus of claim 11 wherein said plurality of said stripper pin devices are precharged gas springs.

14. The wheel rim expanding tooling apparatus of claim 11 wherein said plurality of said stripper pin devices are adjustable gas springs.

15. The wheel rim expanding tooling apparatus of claim 11 wherein each of said threaded openings includes a first portion and a second portion, said first portion having partial internal threads and said second portion having full internal threads and a constant diameter along an entire length thereof.

16. The wheel rim expanding tooling apparatus of claim 11 wherein each of said plurality of said stripper pin devices includes an outer end portion, an intermediate portion, and an inner portion, said outer portion being non-threaded portion and defining a first diameter, said intermediate portion provided with external threads and defining a second diameter, and said inner portion being non-threaded and defining a third diameter.

17. The wheel rim expanding tooling apparatus of claim 16 wherein said third diameter is greater than said first diameter and less than said second diameter.

18. A wheel rim expanding tooling apparatus adapted to produce an expanded finished wheel rim, the expanded wheel rim having an inboard tire bead seat retaining flange, an inboard tire bead seat, a generally axially extending well, and outboard tire bead seat, the wheel rim expanding tooling apparatus comprising:

an inboard wheel rim expanding tooling assembly including a plurality of segmented inboard wheel rim press members, each of said plurality of segmented inboard wheel rim press members including an outer surface having a desired profile which is adapted to engage an inner surface of the wheel rim and expand the wheel rim to a desired final profile;

an outboard wheel rim expanding tooling assembly including a plurality of segmented outboard wheel rim press members, each of said plurality of segmented outboard wheel rim press members including an outer surface having a desired profile which is adapted to engage an inner surface of the wheel rim and expand the wheel rim to a desired final profile; and a plurality of gas spring stripper pin devices installed in threaded openings provided in said plurality of segmented outboard wheel rim press members, said plurality of stripper pin devices installed in said threaded openings of said plurality of segmented outboard wheel rim press members from said outer surface side thereof; wherein each of said plurality of gas spring stripper pin devices is provided with an outwardly facing internal socket which is accessible from said outer surface side of said plurality of segmented outboard wheel rim press members to thereby enable the position of said plurality of gas spring stripper pin devices to be adjusted from said outer surface side after said plurality of gas spring stripper pin devices are installed.

19. The wheel rim expanding tooling apparatus of claim 18 wherein each of said threaded openings includes a first portion and a second portion, said first portion having partial internal threads and said second portion having full internal threads and a constant diameter along an entire length thereof.

20. The wheel rim expanding tooling apparatus of claim 18 wherein each of said plurality of said stripper pin devices includes an outer end portion, an intermediate portion, and an inner portion, said outer portion being non-threaded portion and defining a first diameter, said intermediate portion provided with external threads and defining a second diameter, and said inner portion being non-threaded and defining a third diameter.

21. The wheel rim expanding tooling apparatus of claim 18 wherein said third diameter is greater than said first diameter and less than said second diameter.

* * * * *